US010364984B2

(12) United States Patent
Colannino et al.

(10) Patent No.: US 10,364,984 B2
(45) Date of Patent: Jul. 30, 2019

(54) BURNER SYSTEM INCLUDING AT LEAST ONE COANDA SURFACE AND ELECTRODYNAMIC CONTROL SYSTEM, AND RELATED METHODS

(71) Applicant: ClearSign Combustion Corporation, Seattle, WA (US)

(72) Inventors: Joseph Colannino, Mercer Island, WA (US); Igor Alexeevitch Krichtafovitch, Kirkland, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 1013 days.

(21) Appl. No.: 14/167,875

(22) Filed: Jan. 29, 2014

(65) Prior Publication Data

US 2014/0212820 A1 Jul. 31, 2014

Related U.S. Application Data

(60) Provisional application No. 61/758,362, filed on Jan. 30, 2013.

(51) Int. Cl.
*F23C 99/00* (2006.01)
*F23D 14/84* (2006.01)

(52) U.S. Cl.
CPC ..... *F23D 14/84* (2013.01); *F23C 99/001* (2013.01); *F23D 2900/00011* (2013.01)

(58) Field of Classification Search
CPC ..... F23C 99/001
(Continued)

(56) References Cited

U.S. PATENT DOCUMENTS 2,604,936 A * 7/1952 Kaehni ..... F23C 99/001 122/14.21
3,167,109 A 1/1965 Wobig
(Continued)

FOREIGN PATENT DOCUMENTS

EP 0844434 5/1998
EP 1139020 8/2006
(Continued)

OTHER PUBLICATIONS

James Lawton et al., Electrical Aspects of Combustion, 1969, pp. 81, 296, Clarendon Press, Oxford, England.
(Continued)

*Primary Examiner* — Steven B McAllister
*Assistant Examiner* — Desmond C Peyton
(74) *Attorney, Agent, or Firm* — Dorsey & Whitney LLP

(57) ABSTRACT

Embodiments of the invention are directed to a burner system including at least one Coanda surface and at least two electrodes that are biased in a manner to influences a location of fuel flow relative to the at least one Coanda surface and related methods. In an embodiment, a burner system includes at least one Coanda surface, at least one nozzle positioned and configured to emit a fuel flow at least proximate to the at least one Coanda surface, at least two electrodes, and a voltage source operably coupled to the at least two electrodes. The voltage source may be configured to bias the at least two electrodes to generate an electric field at least proximate to the at least one Coanda surface that influences a location of the fuel flow and/or a flame relative to the at least one Coanda surface.

14 Claims, 7 Drawing Sheets

(58) Field of Classification Search
USPC ..... 431/2, 5, 9, 116, 354; 60/750, 776, 204; 310/62; 271/182; 239/265.17; 180/129
See application file for complete search history.

(56) References Cited

U.S. PATENT DOCUMENTS 3,224,485 A * 12/1965 Blomgren, Sr. ..... F23C 99/001 165/903
3,269,446 A 8/1966 Luther
3,358,731 A * 12/1967 Donnelly ..... F23C 99/001 431/262
3,749,545 A 7/1973 Velkoff
3,841,824 A * 10/1974 Bethel ..... F23C 99/001 123/536
4,020,388 A 4/1977 Pratt, Jr.
4,111,636 A * 9/1978 Goldberg ..... F23C 99/001 431/2
4,201,140 A 5/1980 Robinson
4,340,024 A 7/1982 Suzuki et al.
5,515,681 A * 5/1996 DeFreitas ..... F23Q 13/00 60/39.821
6,447,637 B1 9/2002 Todorov et al.
7,243,496 B2 * 7/2007 Pavlik ..... F23C 99/001 431/2
7,878,798 B2 2/2011 Poe et al.
8,245,951 B2 * 8/2012 Fink ..... F23D 11/32 123/538
8,529,247 B2 9/2013 Poe et al.
8,568,134 B2 10/2013 Poe et al.
8,851,882 B2 10/2014 Hartwick et al.
8,881,535 B2 11/2014 Hartwick et al.
8,911,699 B2 12/2014 Colannino et al.
9,151,549 B2 10/2015 Goodson et al.
9,243,800 B2 1/2016 Goodson et al.
9,267,680 B2 2/2016 Goodson et al.
9,284,886 B2 3/2016 Breidenthal et al.
9,289,780 B2 3/2016 Goodson
9,310,077 B2 4/2016 Breidenthal et al.
9,366,427 B2 6/2016 Sonnichsen et al.
9,371,994 B2 6/2016 Goodson et al.
9,377,188 B2 6/2016 Ruiz et al.
9,377,189 B2 6/2016 Ruiz et al.
9,377,195 B2 6/2016 Goodson et al.
9,441,834 B2 9/2016 Colannino et al.
9,453,640 B2 9/2016 Krichtafovitch et al.
9,469,819 B2 10/2016 Wiklof
2002/0092302 A1 7/2002 Johnson et al.
2005/0116166 A1 * 6/2005 Krichtafovitch ..... H01T 19/00 250/324
2005/0208442 A1 9/2005 Heiligers et al.
2005/0208446 A1 9/2005 Jayne
2007/0020567 A1 * 1/2007 Branston ..... F02M 27/04 431/8
2011/0072786 A1 * 3/2011 Tokuda ..... F01N 3/01 60/275
2012/0317985 A1 * 12/2012 Hartwick ..... F23D 14/84 60/722
2013/0170090 A1 * 7/2013 Colannino ..... F23C 99/001 361/225
2013/0230810 A1 9/2013 Goodson et al.
2013/0260321 A1 10/2013 Colannino et al.
2013/0291552 A1 11/2013 Smith et al.
2013/0323661 A1 12/2013 Goodson et al.
2013/0333279 A1 12/2013 Osler et al.
2013/0336352 A1 12/2013 Colannino et al.
2014/0038113 A1 * 2/2014 Breidenthal ..... F23N 5/16 431/2
2014/0051030 A1 2/2014 Colannino et al.
2014/0065558 A1 3/2014 Colannino et al.
2014/0076212 A1 3/2014 Goodson et al.
2014/0080070 A1 3/2014 Krichtafovitch et al.
2014/0162195 A1 6/2014 Lee et al.
2014/0162196 A1 6/2014 Krichtafovitch et al.
2014/0162197 A1 6/2014 Krichtafovitch et al.
2014/0162198 A1 6/2014 Krichtafovitch et al.
2014/0170569 A1 6/2014 Anderson et al.
2014/0170571 A1 * 6/2014 Casasanta, III ..... B22F 3/1055 431/8
2014/0170575 A1 6/2014 Krichtafovitch
2014/0170576 A1 6/2014 Colannino et al.
2014/0170577 A1 6/2014 Colannino et al.
2014/0196368 A1 7/2014 Wiklof
2014/0208758 A1 7/2014 Breidenthal et al.
2014/0216401 A1 8/2014 Colannino et al.
2014/0227645 A1 8/2014 Krichtafovitch et al.
2014/0227646 A1 8/2014 Krichtafovitch et al.
2014/0227649 A1 8/2014 Krichtafovitch et al.
2014/0248566 A1 9/2014 Krichtafovitch et al.
2014/0255855 A1 9/2014 Krichtafovitch
2014/0255856 A1 9/2014 Colannino et al.
2014/0272731 A1 9/2014 Breidenthal et al.
2014/0287368 A1 9/2014 Krichtafovitch et al.
2014/0295094 A1 10/2014 Casasanta, III
2014/0295360 A1 10/2014 Wiklof
2014/0335460 A1 11/2014 Wiklof et al.
2015/0079524 A1 3/2015 Colannino et al.
2015/0104748 A1 4/2015 Dumas et al.
2015/0107260 A1 4/2015 Colannino et al.
2015/0118629 A1 4/2015 Colannino et al.
2015/0121890 A1 5/2015 Colannino et al.
2015/0140498 A1 5/2015 Colannino
2015/0147704 A1 5/2015 Krichtafovitch et al.
2015/0147705 A1 5/2015 Colannino et al.
2015/0147706 A1 5/2015 Krichtafovitch et al.
2015/0219333 A1 8/2015 Colannino et al.
2015/0226424 A1 8/2015 Breidenthal et al.
2015/0241057 A1 8/2015 Krichtafovitch et al.
2015/0276211 A1 10/2015 Colannino et al.
2015/0338089 A1 11/2015 Krichtafovitch et al.
2015/0345780 A1 12/2015 Krichtafovitch
2015/0345781 A1 12/2015 Krichtafovitch et al.
2015/0362178 A1 12/2015 Karkow et al.
2016/0018103 A1 1/2016 Karkow et al.
2016/0033125 A1 2/2016 Krichtafovitch et al.
2016/0040872 A1 2/2016 Colannino et al.
2016/0091200 A1 3/2016 Colannino et al.
2016/0123576 A1 5/2016 Colannino et al.
2016/0138800 A1 5/2016 Anderson et al.
2016/0161110 A1 6/2016 Krichtafovitch et al.
2016/0161115 A1 6/2016 Krichtafovitch et al.
2016/0215974 A1 7/2016 Wiklof
2016/0245507 A1 8/2016 Goodson et al.
2016/0273763 A1 9/2016 Colannino et al.
2016/0273764 A1 9/2016 Colannino et al.
2016/0290633 A1 10/2016 Cherpeske et al.
2016/0290639 A1 10/2016 Karkow et al.
2016/0298836 A1 10/2016 Colannino et al.

FOREIGN PATENT DOCUMENTS

FR 2577304 12/1989
JP 61265404 A * 11/1986 ..... F23C 99/001
JP 2001-021110 1/2001
JP 2001-033040 2/2001
WO WO 1996/001394 1/1996
WO WO 2012/109499 8/2012
WO WO 2013/181569 12/2013
WO WO 2015/089306 6/2015
WO WO 2015/103436 7/2015

OTHER PUBLICATIONS

U.S. Appl. No. 61/758,362, filed Jan. 30, 2012, Colannino et al.
M. Zake et al., "Electric Field Control of NOx Formation in the Flame Channel Flows." Global Nest: The Int. J. May 2000, vol. 2, No. 1, pp. 99-108.

* cited by examiner

BURNER SYSTEM INCLUDING AT LEAST ONE COANDA SURFACE AND ELECTRODYNAMIC CONTROL SYSTEM, AND RELATED METHODS

CROSS-REFERENCE TO RELATED APPLICATIONS

This application claims priority to U.S. Provisional Application No. 61/758,362 filed on 30 Jan. 2013, the disclosure of which is incorporated herein, in its entirety, by this reference.

BACKGROUND

There are a wide variety of burners available that are used in a wide variety of applications. The operation of burner systems raises many concerns. Undesirable outputs (e.g., $NO_x$), excessive fuel consumption, and heat output are examples of these concerns.

As a result, many attempts have been made to address these concerns. These attempts include fuel composition, diluents, premixing, or the like. By changing or including structure that are directed to these aspects of burner technology, the operation and efficiencies of burner systems has improved over time.

However, there is still a need for burner systems and methods having improved operation and efficiency.

SUMMARY

Figure 1:
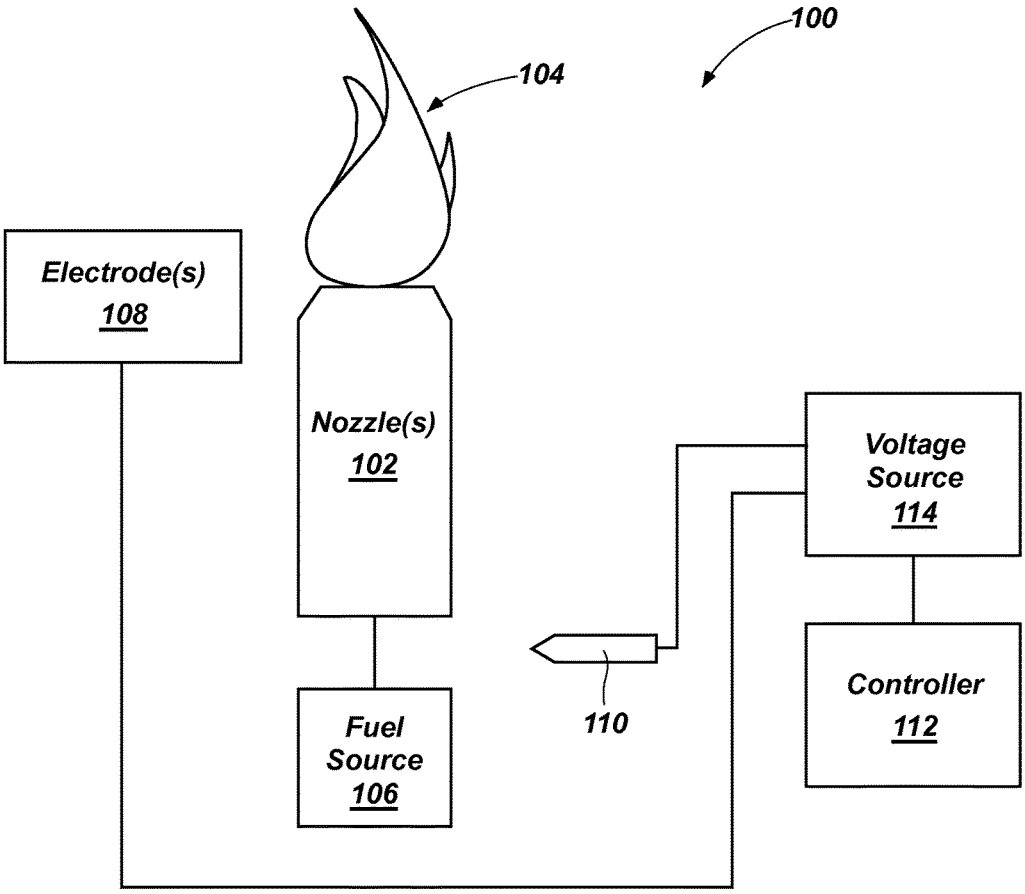
FIG. 1 is a functional block diagram of an embodiment of a burner system that includes at least one Coanda surface.

Embodiments of the invention are directed to a burner system including at least one Coanda surface and at least two electrodes that are biased in a manner to influence a location of fuel flow and/or a flame relative to the at least one Coanda surface (e.g., directing the fuel flow toward or away from the at least one Coanda surface), and related methods. In an embodiment, a burner system includes at least one Coanda surface, at least one nozzle positioned and configured to emit a fuel flow at least proximate to the at least one Coanda surface, at least two electrodes, and a voltage source operably coupled to the at least two electrodes. The voltage source may be configured to bias the at least two electrodes to generate an electric field at least proximate to the at least one Coanda surface that influences a location of the fuel flow and/or the flame relative to the at least one Coanda surface.

In an embodiment, a method of operating a burner system is disclosed. The method includes directing a charged fuel flow from at least one nozzle toward at least one Coanda surface. The method additionally includes biasing at least two electrodes to generate an electric field at least proximate to the at least one Coanda surface. The method further includes at least partially based on the electric field, influencing a location of the charged fuel flow and/or the flame relative to the at least one Coanda surface.

Features from any of the disclosed embodiments may be used in combination with one another, without limitation. In addition, other features and advantages of the present disclosure will become apparent to those of ordinary skill in the art through consideration of the following detailed description and the accompanying drawings.

DETAILED DESCRIPTION

Embodiments of the invention are directed to a burner system including at least one Coanda surface and at least two electrodes that are biased in a manner to influence a location of fuel flow relative to the at least one Coanda surface (e.g., directing the fuel flow toward or away from the at least one Coanda surface), and related methods. More specifically, embodiments disclosed herein relate to burner systems and methods for controlling characteristics of flames and/or fuel in burner systems, such as controlling stoichiometry of the fuel, shape of the flame, location of the fuel flow and/or flame relative to the at least one Coanda surface, or any combination thereof. For example, by biasing the at least two electrodes so that the fuel flow or the flame is attracted and/or better conforms to the at least one Coanda surface, heat may be more effectively extracted from the fuel flow and/or the flame so that the combustion temperature is lowered, thereby reducing pollutants (e.g., $NO_x$).

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

Coanda surfaces are surfaces that are configured for producing fluid flow exhibiting the Coanda effect. The Coanda effect relates to the tendency of a fluid to follow a surface. When properly configured, the fluid will follow, or "hug" or generally conform to a Coanda surface even as the surface curves away from the initial fluid flow direction. In the context of burners and by way of example only, a Coanda surface may be used to aid in mixing fuel with air and/or a diluent. By placing a Coanda surface in the flow path of a fuel stream, the fuel may be more effectively mixed with air and/or diluent over the Coanda surface, heat from the flame may be conductive to the Coanda surface to lower the flame temperature, or combinations thereof. This may result in reduced pollutants (e.g., $NO_x$) and other efficiencies. A flame may also follow a Coanda surface. While a Coanda surface may be used to control the stoichiometry and/or the geometry of a flame to some extent, any of the electrodynamic electrode control systems disclosed herein provide greater control over the stoichiometry of the fuel and/or flame, geometry of the flame, charge density of the flame, location of the fuel flow and/or flame relative to the Coanda surface, or combinations thereof.

FIG. 1 is a functional block diagram of an embodiment of a burner system 100 that includes at least one Coanda surface. The burner system 100 includes one or more nozzles 102 that receives fuel from a fuel source 106. The fuel may be solid, liquid, gas, or combinations thereof. When ignited, the fuel burns in a flame area 104. The flame area 104 may include a flame and an area around the flame, and may further include areas of uncombusted fuel.

The burner system 100 further includes a charger 110 that is configured to inject charge into the fuel and/or the flame area 104. By injecting charge with the charger 110, the fuel, flame area, flame, or combinations thereof acquires a net electrical charge (e.g., a net positive or negative charge). In an embodiment, the charger 110 may include a corona electrode (e.g., a sharpened electrode or saw blade) configured to generate ions that are injected into the fuel, flame area, flame, or combinations thereof to impart the net electrical charge.

As a result of this net electrical charge generated by the charger 110 in the flame area 104, electrode(s) 108 may affect certain characteristics of the fuel, the flame area, the flame, or combinations thereof. In an embodiment, at least one of the electrode(s) 108 may be incorporated with one or more Coanda surfaces that have placed thereon an electrical conductor or an electrically conductive structure to form one or more Coanda electrodes. In another embodiment, the electrode(s) 108 may include two or more electrodes that are spaced from and separate from the Coanda surface(s).

The electrodes of the electrode(s) 108 (including Coanda electrodes, counter electrodes, and corona electrodes) may be placed in various locations relative to the flame area 104. For example, a corona electrode may be placed below the flame area 104 and below the Coanda surface(s) such that the corona electrode may inject charge into the fuel flow, while in other embodiments, the corona electrode may be positioned to inject charge into the flame itself. The electrodes may then shape and/or influence one or more of the fuel flow, the burning fuel, or the flame using the Coanda effect as well as the interaction between the potential of the electrodes and the charged fuel and/or flame. For example, the electrodes may be biased to attract or repel the charged fuel and/or flame in a desired manner while still exhibiting the Coanda effect.

The burner system 100 further includes a controller 112 that may include one or more processors or other special purpose computers and associated components. The controller 112 may be configured to control an amount of charge injected by the charger 110, the potential and/or polarity of the various electrodes in the burner system 100, a fuel flow rate, fuel pressure, mixing ratios, or any combination thereof. The control system 112 may be further operably coupled to a voltage source 114 operably coupled to the electrode(s) 108 and/or the charger 110 for applying a voltage thereto. For example, the electrodes proximate to the Coanda surface(s) may be biased to generate an electric field that attracts or repels the charged fuel and/or flame in a desired manner.

Figure 2A:
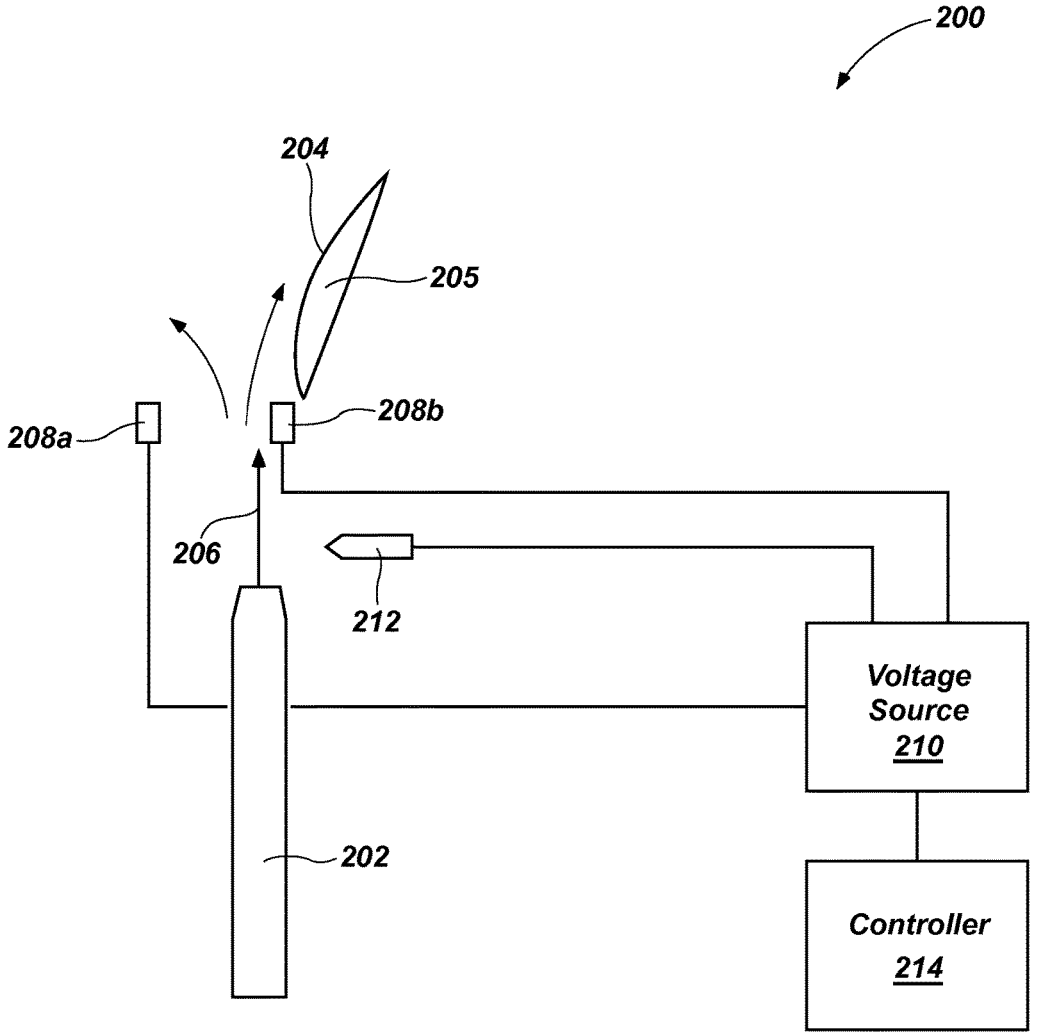
FIG. 2A is a cross-sectional view of an embodiment of a burner system that includes at least one Coanda surface and at least two electrodes configured to influence a location of fuel flow and/or a flame relative to the at least one Coanda surface when biased.

FIGS. 2A-4 illustrate a number of different more detailed embodiments of burner systems that employ at least one Coanda surface and the teachings of the burner system 100 shown in FIG. 1. FIG. 2A is a cross-sectional view of an embodiment of a burner system 200 that includes at least one Coanda surface and at least two electrodes configured to influence a location of fuel flow and/or a flame relative to the at least one Coanda surface when biased. The burner system 200 includes at least one nozzle 202 positioned below at least one Coanda surface 204 and configured to emit a fuel flow 206 toward the at least one Coanda surface 204. A body 205 from which the at least one Coanda surface 204 is fabricated may be made from any suitable material, such as a refractory material and/or a dielectric material, which is capable of withstanding the high-temperature environment associated with combustion. The burner system 200 further includes at least two electrodes 208*a* and 208*b* that are positioned proximate to the at least one Coanda surface 204 and spaced from each other. A voltage source 210 is operably coupled to the at least two electrodes 208*a* and 208*b* and a charger 212, such as a corona electrode. A controller 214 is operably coupled to the voltage source 210 to control the operation thereof and direct the charger 212 to emit charges into the fuel flow and/or flame generated by the at least one nozzle 202 and direct operation of the at least two electrodes 208*a* and 208*b*.

The at least two electrodes 208*a* and 208*b* are spaced and positioned relative to the at least one Coanda surface 204 so that an electric field generated therebetween by application of a voltage therebetween by the voltage source 210 influences a location of the fuel and/or flame relative to the at least one Coanda surface 204. For example, if the fuel and/or flame is charged positively or negatively, a potential having an opposite polarity as the charge of the fuel and/or flame between the at least two electrodes 208*a* and 208*b* causes the charged fuel and/or flame to be attracted to the at least one Coanda surface 204 and further conform to the curvature of the at least one Coanda surface 204 and/or better maintain conformity between the charged fuel and/or flame and the at least one Coanda surface 204. As another example, if the fuel and/or flame is charged positively or negatively, a potential of the same polarity as the charge of the fuel and/or flame between the at least two electrodes 208*a* and 208*b* causes the charged fuel and/or flame to be repelled from the at least one Coanda surface 204 which may be desired in certain combustion applications.

The voltage applied to the electrodes 208*a* and 208*b* (and/or to other electrodes in a burner system 200) to generate the electric field therebetween may be DC, AC, invertible, chopped, or have another signal shape. In some embodiments, currents may be in a milliamp range (e.g., 100 milliamp range), while the voltages may be in a kilovolt range. Other ranges, higher and lower currents/voltages may be used or applied to the electrodes 208*a* and 208*b* and/or to other electrodes in the burner system 200.

Figure 2B:
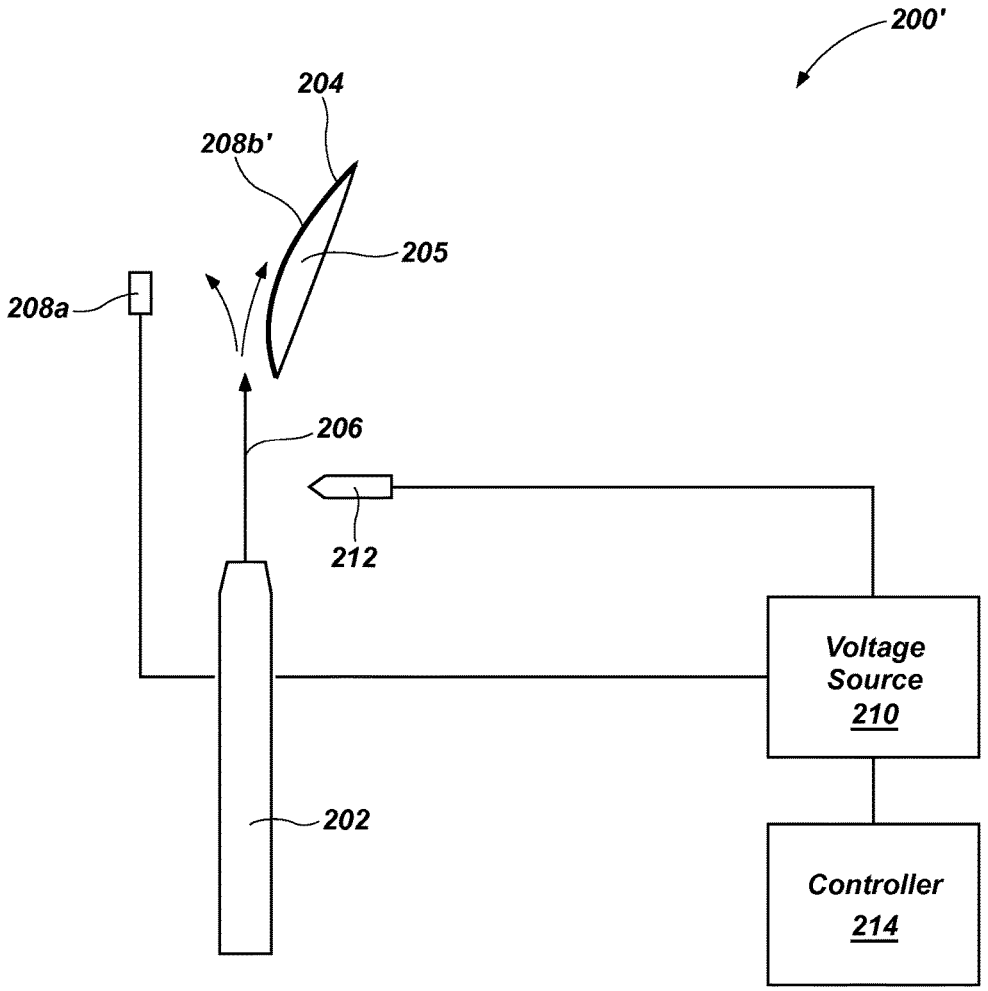
FIG. 2B is a cross-sectional view of an embodiment of a burner system that includes at least one Coanda surface that forms at least one Coanda electrode configured to influence a location of fuel flow and/or a flame relative to the at least one Coanda surface.

FIG. 2B is a cross-sectional view of an embodiment of a burner system 200' that includes at least one Coanda surface that forms at least one Coanda electrode configured to influence a location of fuel flow and/or a flame relative to the at least one Coanda surface. In the burner system 200', the second electrode 208*b* is formed on and/or forms at least part of the at least one Coanda surface 204 to define at least one Coanda electrode 208*b'*. For example, the at least one Coanda surface 204 may be plated or covered with an electrically conductive material (e.g., a metallic material), such as generally uniform coating, non-touching electrically conductive traces, or a mesh configuration or other electrically conductive configurations. In the case of electrically conductive traces, the electrically conductive traces may be controlled independently, connected at some point on the at least one Coanda surface 204, or connected at a point remote from the at least one Coanda surface 204. The at least one Coanda electrode 208*b'* may be configured to withstand high temperatures as well such as by being fabricated from an electrically conductive high-temperature resistant material (e.g., a refractory metal or alloy). The at least one Coanda electrode 208*b'* may cover all or a portion of the at least one Coanda surface 204. The electrical connections to the at least one Coanda electrode 208*b'* may be disposed inside or at least partially inside of the body 205 or otherwise protected from the heat associated with the combustion environment. In other embodiments, the body 205 defining the at least one Coanda surface 204 may be formed of a suitable electrically conductive metallic material, and substantially the entire body 205 functions as a Coanda electrode.

Figure 3A:
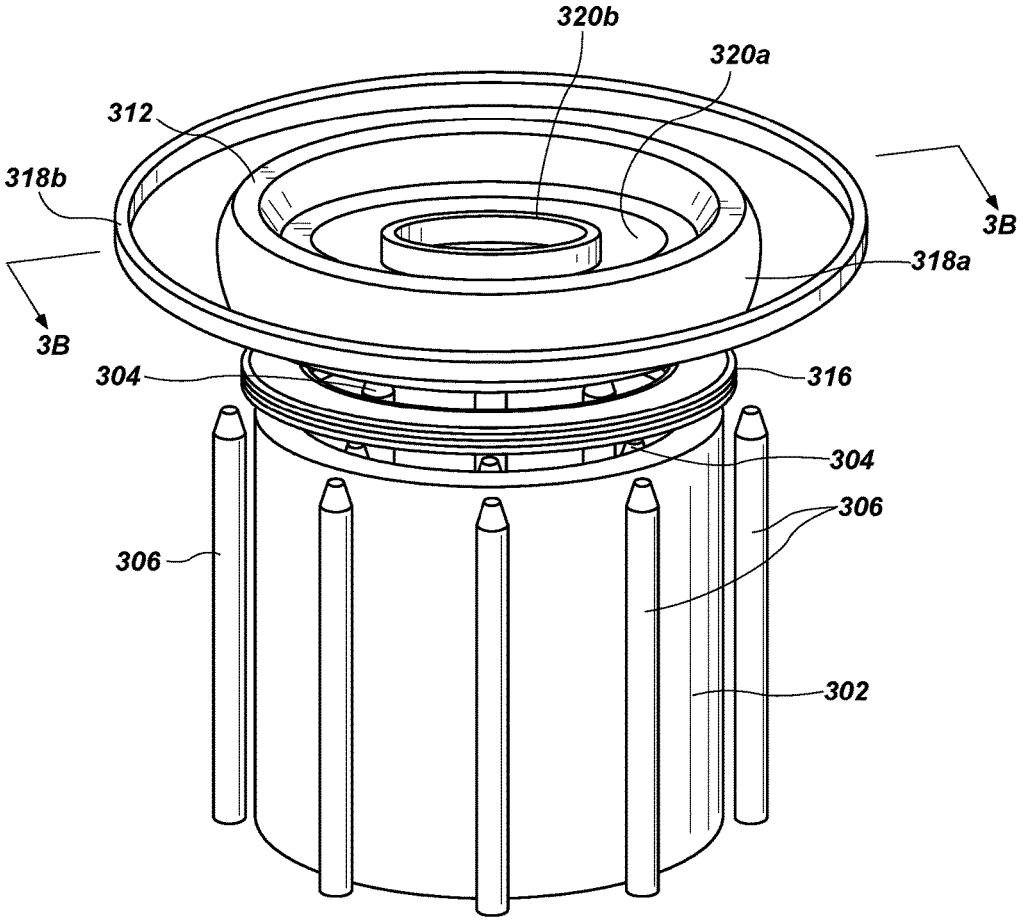
FIG. 3A is a isometric view of an embodiment of a burner system that includes two Coanda electrodes and a charger that injects charge into the burner system.
Figure 3B:
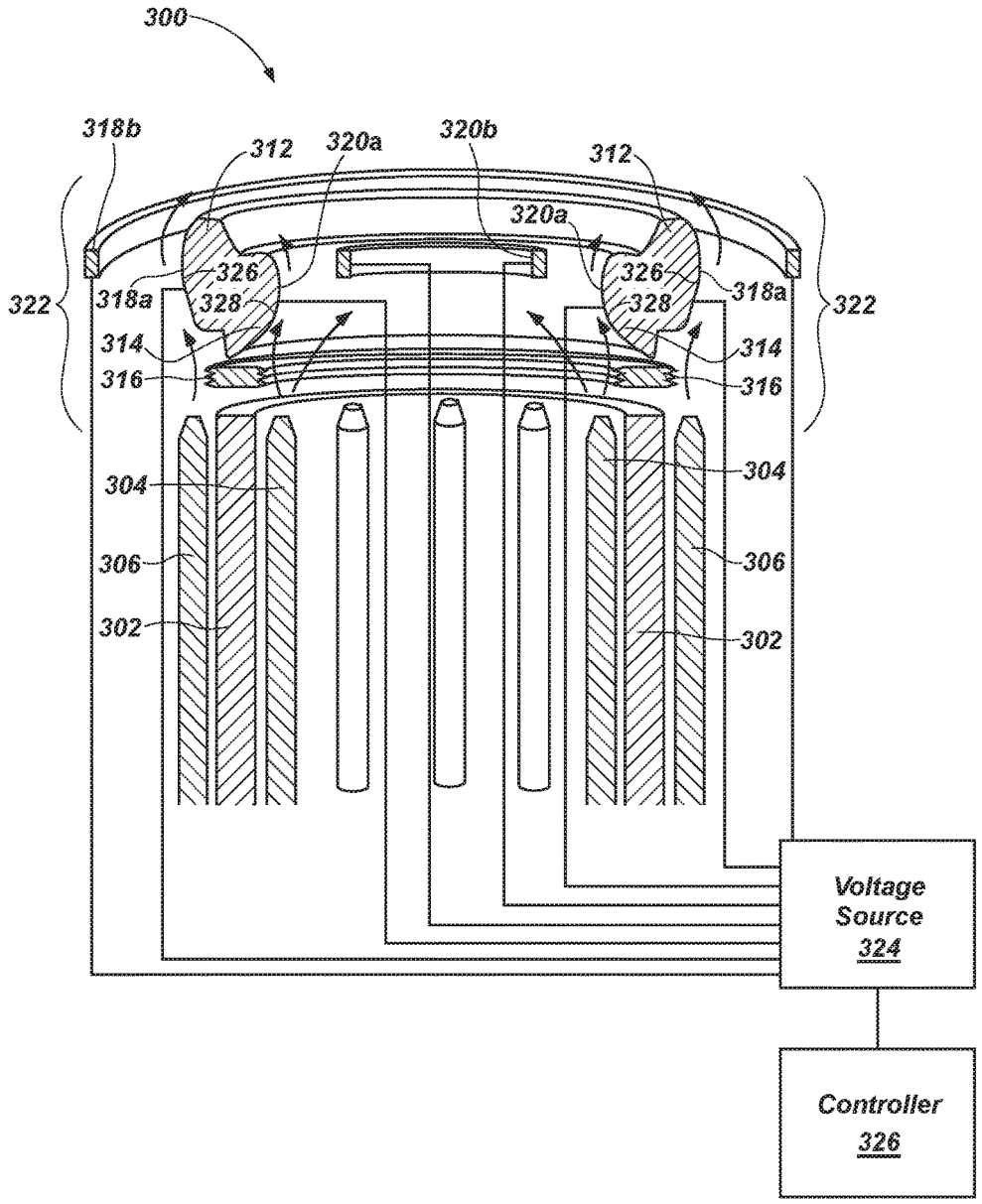
FIG. 3B is an isometric cutaway view of the burner system shown in FIG. 3A taken along line 3B-3B.

FIGS. 3A and 3B are isometric and isometric cutaway views, respectively, an embodiment of a burner system 300 that includes at least two Coanda surfaces and multiple nozzles. The burner system 300 includes a body 302, which may be made from a refractory material or other suitable heat-resistant material. The body 302 is configured to withstand high temperatures and may be arranged in a tubular structure. In some embodiments, the body 302 may be formed of multiple similarly configured components that are connected together, while in other embodiments the body 302 may be unitary. The burner system 300 may include multiple inner nozzles represented as inner nozzles 304 and multiple outer nozzles represented by outer nozzles 306, each of which extends about the body 302. In some embodiments, some or all of the nozzles 304 and 306 may be venturi nozzles, while other nozzles may not perform any mixing but may carry only fuel.

When the fuel and/or mixed fuel exits the nozzles 304 and 306 and enters a flame area 322, the fuel and/or the mixed fuel encounters a Coanda member 312 (e.g., a Coanda tile) that includes an outer Coanda surface 326 and an inner Coanda surface 328. In an embodiment, the Coanda member 312 may be a substantially continuous annular body, while in other embodiments the Coanda member 312 may be discontinuous, such as an interrupted annular body. The fuel and/or combusting fuel in the flame area 322 may burn more efficiently due to the Coanda surfaces 326 and 328. For example, the Coanda surfaces 326 and 328 may improve the stoichiometry of the fuel by allowing the fuel to mix better with air and/or a diluent as the fuel flows over the Coanda surfaces 326 and 328. As a result, the burning and combustion is more efficient since the fuel mixing becomes more efficient.

In the illustrated embodiment, both of the Coanda surface 326 and the Coanda surface 328 may be configured as electrodes as well. Thus, the Coanda surfaces 326 and 328 function as Coanda electrodes 318*a* and 320*a* by at least partially covering the Coanda surfaces 326 and 328 with an electrical conductor of some configuration or forming the Coanda bodies 312 and 314 from an electrically conductive material, such as a metal or alloy (e.g., a refractory metal or alloy). In an embodiment, the Coanda electrodes 318*a* and 320*a* may be formed by stamping a steel or other metallic plate onto the surface or by plating the Coanda surfaces 326 and 328 with an electrically conductive material, such as a suitable metallic material. In an embodiment, the Coanda electrodes 318*a* and 320*a* may be electrically conductive traces (which may or may not touch) that may have a common voltage source or that may be remotely connected or that may be controlled independently. Corresponding counter electrodes 318*b* and 320*b* are provided that are spaced from corresponding Coanda electrodes 318*a* and 320*a*. For example, the counter electrodes 318*b* and 320*b* may each be electrically conductive rings, a plurality of circumferentially-spaced electrodes, or other suitable geometry. It should be noted that the electrodes in the burner system 300 may be arranged in multiple other configurations. For example, in other embodiments, separate electrodes may be provided that are separate from and spaced from the respective Coanda surfaces 326 and 328 similar to the burner system 200 shown in FIG. 2A. The size, shape, orientation, number of electrodes, or combinations thereof may be varied and may be related to the configuration of the burner system itself.

The burner system 300 further includes a charger having a corona electrode 316 that is located, in the illustrated embodiment, near a base or bottom portion of the Coanda surfaces 326 and 328. For example, the corona electrode 316 may be configured as a ring having serrated or other sharp features from which charges are emitted into the fuel flow output by the nozzles 304 and 306. However, in other embodiments, the charger may be placed in other locations so that the fuel from a fuel source (not shown) may be charged prior to being output by the nozzles 304 and 306 and/or the flame itself may be charged. By placing the corona electrode 316 (or other type of charger) in a position (e.g., the path of the fuel between the nozzles and the Coanda electrodes 318*a* and 320*a*) to generate ions that may be added to or injected in the fuel, the fuel or the flame area may be charged. By charging or ionizing the fuel and/or the combusting fuel at a given location, the Coanda electrodes 318*a* and 320*a* may also act on the charged fuel, the combusting fuel, the charged flame, or combinations thereof.

The burner system 300 further includes a voltage source 324, under control of a controller 326, operably coupled to the Coanda electrodes 318*a* and 320*a*, and corresponding counter electrodes 318*b* and 320*b*, and the corona electrode 316. In operation, a voltage applied to the Coanda electrodes 318*a* and 320*a* and corresponding counter electrodes 318*b* and 320*b* generates corresponding electric fields proximate to or adjacent to the corresponding Coanda electrodes 318*a* and 320*a*. The voltage source 324 under control of the controller 326 also applies a suitable voltage to the corona electrode 316 to cause charges to be emitted into the fuel flow from the nozzles 304 and 306.

By application of a suitable voltage via the voltage source 324 to the Coanda electrodes 318*a* and 320*a* and corresponding counter electrodes 318*b* and 320*b* to generate corresponding electric fields proximate to or adjacent to the Coanda electrodes 318*a* and 320*a*, the fuel and/or flame having injected charges may be repelled from or attracted to the Coanda electrodes 318*a*/320*a* and Coanda surfaces 326/328 such that burning occurs away from or closer to the surface of the Coanda surfaces 326 and 328. For example, when the fuel and/or flame is attracted to the Coanda electrodes 318*a*/320*a* and Coanda surfaces 326/328, heat from the flame may be conducted to the Coanda surfaces 326/328 to lower the flame temperature, which may result in reduced pollutants (e.g., $NO_x$) and other efficiencies. If not electrically connected together, the Coanda electrode 318*a* may be controlled differently (e.g., different potential and/or charge) from the Coanda electrode 320*a*.

In some embodiments, the Coanda electrodes 318*a* and 320*a* may be used to control some aspects of the flame and/or fuel and other electrodes (not shown) may be configured to control other aspects of the flame and/or fuel. For example, the Coanda electrodes 318*a* and 320*a* may at least partially control the mixing and location of the fuel and/or flame relative to the Coanda surfaces 326 and 328, while other electrodes may similarly act on the biased flame to control a geometry of the flame such as the flame height. In such an embodiment, one or more electrodes may be arranged above the flame that are biased to effectively repel the flame downward to control flame height. In such an embodiment, each of the electrodes may be connected to the same voltage or electrical source. Alternatively, some of the electrodes may be electrically isolated from other electrodes. For example, the Coanda electrodes 318*a* and 320*a* and/or the corona electrode 316 may be controlled independently due, for example, to differing voltage requirements.

In another embodiment, the Coanda electrodes 318*a* and 320*a* and other electrodes may be configured to operate as discussed herein without injecting charge with the corona electrode 316. In other words, the fuel and/or flame already includes some ions or charged particles and the electrodes may operate on the fuel/flame without requiring the injection of charge. Thus, in any of the embodiments disclosed herein, the charger (e.g., a corona electrode) may be omitted.

Figure 4:
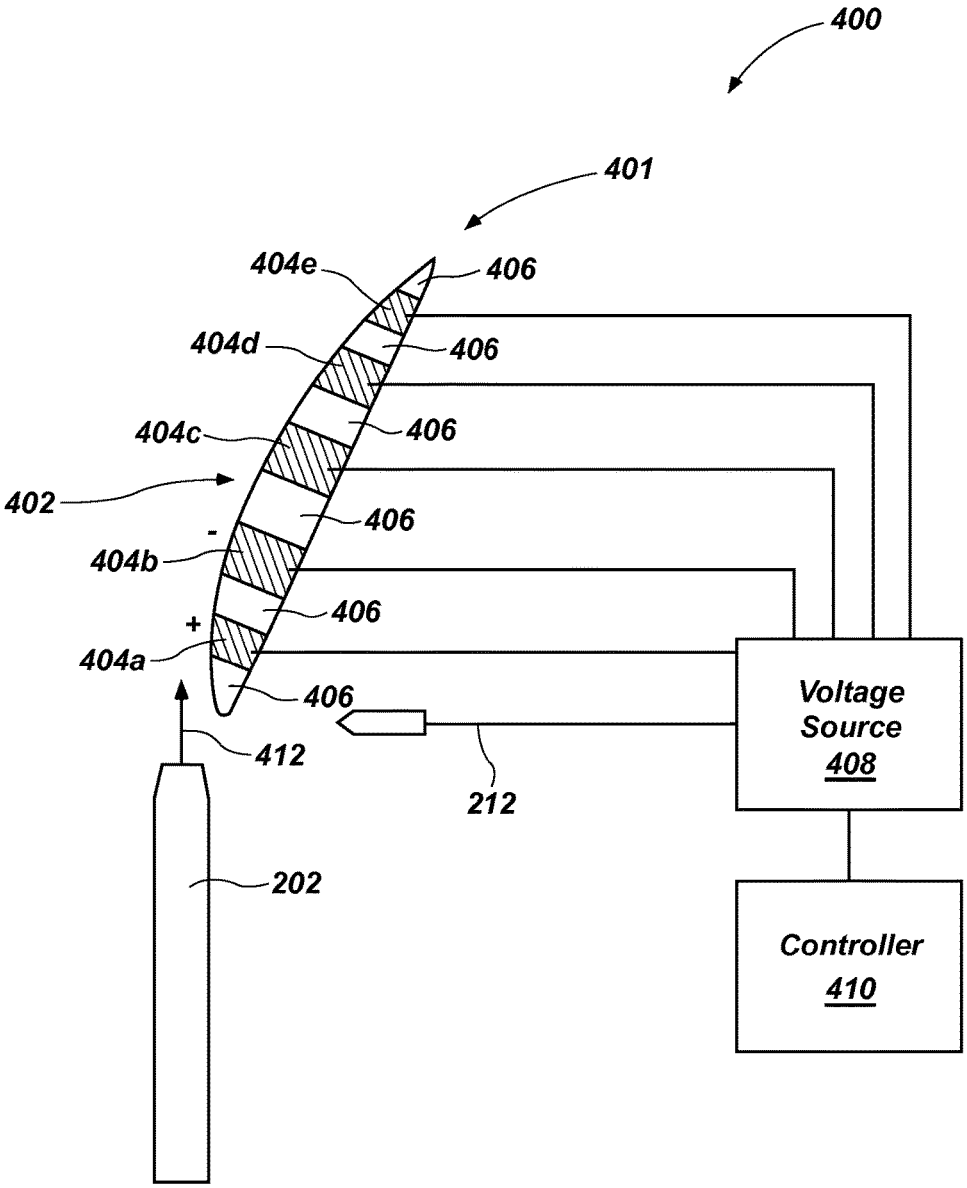
FIG. 4 is a cross-sectional view of an embodiment of a Coanda body including a Coanda surface and a plurality of electrodes integrated therewith.

FIG. 4 is a cross-sectional view of an embodiment of a burner system 400 including a Coanda body 401 including at least one Coanda surface and a plurality of electrodes integrated therewith. The Coanda body 401 includes a Coanda surface 402. The Coanda body 400 further includes a plurality of electrodes 404*a*-404*e* spaced apart by dielectric portions 406. For example, both the plurality of electrodes 404*a*-404*e* and the dielectric portions 406 may be made from a high-temperature resistant material. For example, the plurality of electrodes 404*a*-404*e* may be made from a refractory metal or alloy and the dielectric portions 406 may be made from a number of different high-temperature resistant ceramics such as silicon carbide or silicon nitride. Thus, the plurality of electrodes 404*a*-404*e* and the dielectric portions 406 define the Coanda surface 402. Each of the plurality of electrodes 404*a*-404*e* are independently operably coupled to a voltage source 408 that is operably coupled to a controller 410 that controls the operation of the voltage source 408.

In operation, the plurality of electrodes 404*a*-404*e* may be independently biased to selectively generate an electrical field between, for example, two adjacent ones of the plurality of electrodes 404*a*-404*e*. For example, the voltage source 408 may apply a voltage to the electrodes 404*a* and 404*b* to generate an electric field therebetween that promotes sweeping positive charged species from fuel flow 412 output from the nozzle 202 and/or flame along the Coanda surface 402. In a selected time after application of the voltage to the electrodes 404*a* and 404*b*, the voltage source 408 may apply a voltage to the electrodes 404*b* and 404*c* to generate another electric field therebetween that promotes further sweeping positive charged species the fuel flow 412 and/or flame along the Coanda surface 402. The sequential biasing of adjacent pairs of the plurality of electrodes 404*a*-404*e* may be sequentially continued until a voltage is applied to the electrodes 404*d* and 404*e* to generate another electric field therebetween that promotes further sweeping positive charged species along the Coanda surface 402, after which the sequential biasing process may be repeated a selected number of times or repeated continually. This sequential biasing of adjacent ones of the plurality of electrodes 404-*a*-404*e* may help the fuel flow 412 and/or flame further conform to the curvature of the Coanda surface 402 and/or better maintain conformity between the charged fuel and/or flame and the Coanda surface 402.

It should be noted that the number of the plurality of electrodes 404*a*-404*e* illustrated in FIG. 4 is merely an example. Other embodiments may include a greater or fewer number of electrodes than illustrated, as desired or needed for a particular application. Moreover, although this type of Coanda surface is shown on a Coanda surface similar to that shown in FIGS. 2A and 2B, any Coanda surface of any burner system disclosed herein may adapt its Coanda surface(s) to include such a Coanda body and integrated electrodes. Additionally, although this embodiment is discussed in terms of moving positive charged species, if the fuel flow 412 is charged negatively, an opposite polarity bias may be applied sequentially to the plurality of electrodes 404*a*-404*e*. In other embodiment, an array of electrically conductive traces may be disposed on the Coanda surface 402 of the Coanda body 401 via screen printing, plating, or another suitable technique, and the electrically conductive traces may be controlled independently and independently biased as performed in the burner system 400.

Figure 5:
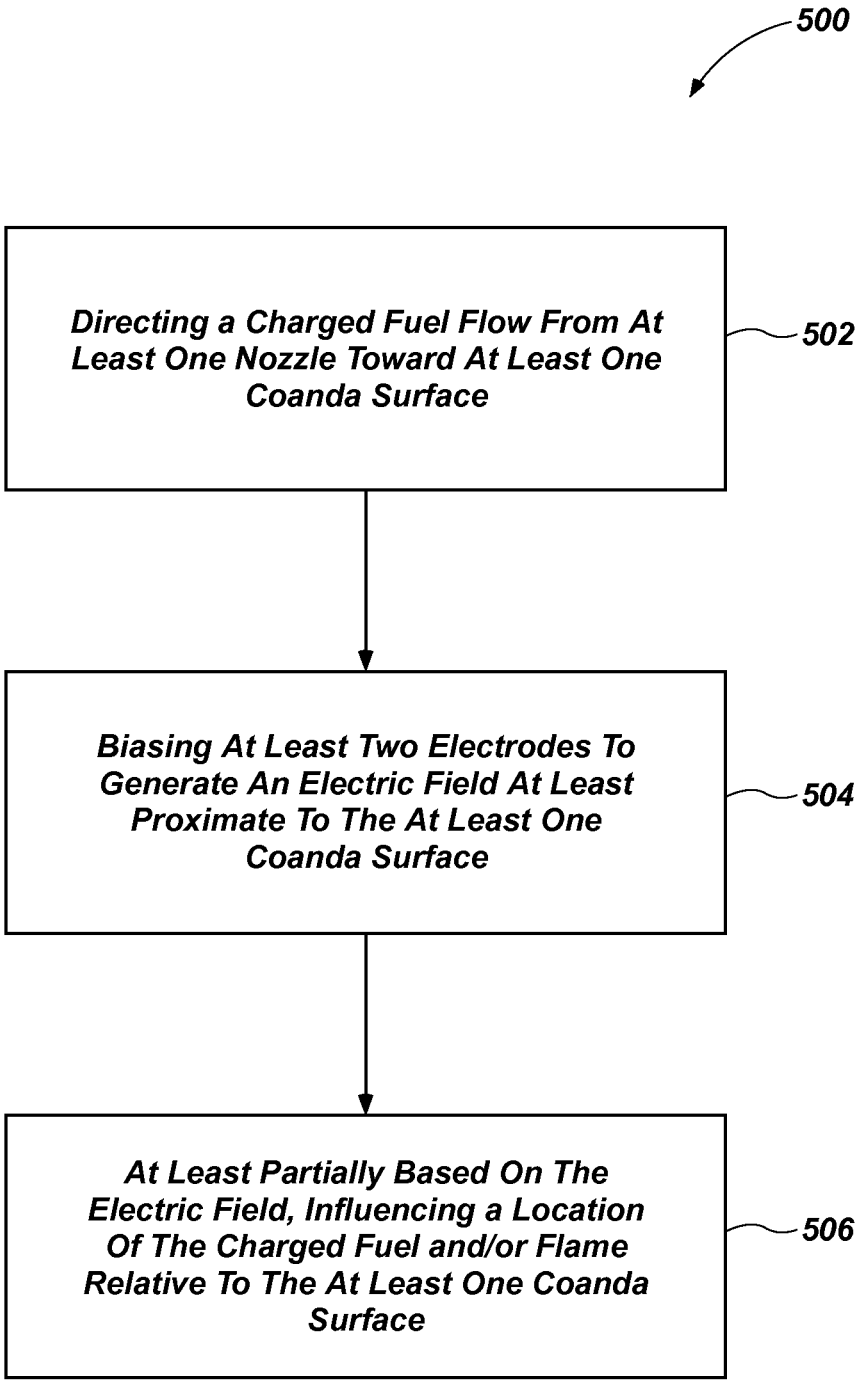
FIG. 5 is a flow diagram of a method of operating a burner system according to an embodiment.

FIG. 5 is a flow diagram of a method 500 of operating a burner system according to an embodiment, which may be implemented via any of the burner systems disclosed herein. The method 500 includes an act 502 of directing a charged fuel flow from at least one nozzle toward at least one Coanda surface. However, in other embodiments, a flame itself output by the nozzle may be charged. The method additionally includes an act 504 of biasing at least two electrodes to generate an electric field at least proximate to the at least one Coanda surface. The method 500 further includes an act 506 of at least partially based on the electric field, influencing a location of the charged fuel flow and/or a flame relative to the at least one Coanda surface. For example, influencing a location of the charged fuel flow or a flame relative to the at least one Coanda surface may include directing the charged fuel flow and/or the flame toward the at least one Coanda surface. As another example, influencing a location of the charged fuel flow relative to the at least one Coanda surface may include directing the charged fuel flow and/or the flame away from the at least one Coanda surface.

The operation of the electrodes, charger, and fuel source of any of the embodiments disclosed herein may be controlled by a controller or computer system and embodiments of the invention may include a special purpose or general-purpose computer including various computer hardware or other hardware including duplexers, amplifiers, or the like, as discussed in greater detail below for controlling the operation of the electrodes, charger, and fuel source.

Embodiments of the invention also include computer-readable media for carrying or having computer-executable instructions or data structures stored thereon for executing any of the methods disclosed herein such as the method 400 or other instructions for directing the operation of any of the burner systems disclosed herein. Such computer-readable media can be any available media that can be accessed by a general purpose or special purpose computer. By way of example, and not limitation, such computer-readable media may include RAM, ROM, EEPROM, CD-ROM or other optical disk storage, magnetic disk storage or other magnetic storage devices, or any other medium which can be used to carry or store desired program code means in the form of computer-executable instructions or data structures and which can be accessed by a general purpose or special purpose computer. Combinations of the above should also be included within the scope of computer-readable media.

Computer-executable instructions include, for example, instructions and data which cause a general purpose computer, special purpose computer, or special purpose processing device to perform a certain function or group of functions. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A burner system, comprising:

at least two electrodes;

at least one integrated Coanda body including an inner Coanda surface and an outer Coanda surface, wherein at least one of the at least two electrodes at least partially defines at least one of the inner Coanda surface or the outer Coanda surface;

at least one nozzle positioned and configured to emit a fuel flow at least proximate to the inner Coanda surface and the outer Coanda surface;

a charger configured to inject charge into the fuel flow prior to the fuel flow flowing at least proximate to the inner Coanda surface and the outer Coanda surface, the charger including at least one sharpened protrusion; and a voltage source operably coupled to the at least two electrodes, the voltage source configured to bias the at least two electrodes to generate an electric field at least proximate to the inner Coanda surface and the outer Coanda surface that influences a location of the fuel flow and/or a flame relative to the inner Coanda surface and the outer Coanda surface, wherein the at least one of the at least two electrodes at least partially defines at least one of the inner Coanda surface or the outer Coanda surface includes a metallic plate disposed on a corresponding one of the inner Coanda surface or outer Coanda surface.

2. The burner system of claim 1, wherein the at least one of the at least two electrodes at least partially defines at least one of the inner Coanda surface or the outer Coanda surface includes a plurality of electrodes that are independently biasable by the voltage source.

3. The burner system of claim 1, wherein at least one of the at least two electrodes is separate and spaced from the inner Coanda surface and the outer Coanda surface.

4. The burner system of claim 1, wherein the voltage source is configured to control a polarity of the at least two electrodes to attract the fuel flow and/or the flame toward the inner Coanda surface and the outer Coanda surface.

5. The burner system of claim 1, wherein the voltage source is configured to control a polarity of the at least two electrodes to repel the fuel flow and/or the flame away from the inner Coanda surface and the outer Coanda surface.

6. The burner system of claim 1, wherein a first one of the at least two electrodes includes a counter electrode that cooperates with a second one of the at least two electrodes to shape the electric field.

7. The burner system of claim 1, wherein the at least one nozzle includes a plurality of nozzles, and wherein the at least one integrated Coanda body forms part of a burner member arranged above the plurality of nozzles.

8. The burner system of claim 7, further comprising a body including an interior surface side and an exterior surface side, wherein the plurality of nozzles are disposed about the body.

9. The burner system of claim 7, wherein the burner member is formed of an electrically conductive metallic material.

10. The burner system of claim 7, wherein the inner and outer Coanda surfaces are configured to interact with the fuel output by the first nozzles and the second nozzles.

11. The burner system of claim 8, wherein the burner member is spaced from the body.

12. The burner system of claim 1, wherein the at least one sharpened protrusion exhibits a serrated shape.

13. The burner system of claim 1, wherein:

the at least one integrated Coanda body exhibits a circumference;

a first one of the at least two electrodes is positioned substantially radially about the at least one integrated Coanda body; and a second one of the at least two electrodes is positioned substantially radially within the at least one integrated Coanda body.

14. The burner system of claim 1, wherein the at least one integrated Coanda body including a plurality of electrodes spaced apart by dielectric portions.

* * * * *